US006623567B2

(12) United States Patent
Nakamura et al.

(10) Patent No.: US 6,623,567 B2
(45) Date of Patent: Sep. 23, 2003

(54) METHOD FOR HIGH CONCENTRATION CARBURIZING AND QUENCHING OF STEEL AND HIGH CONCENTRATION CARBURIZED AND QUENCHED STEEL PART

(75) Inventors: Shotaro Nakamura, Tochigi-ken (JP); Noboru Kuwayama, Kanagawa-ken (JP)

(73) Assignee: Nakamura Industrial Co., Ltd., Tochigi-ken (JP)

( * ) Notice: Subject to any disclaimer, the term of this patent is extended or adjusted under 35 U.S.C. 154(b) by 48 days.

(21) Appl. No.: 09/853,424

(22) Filed: May 10, 2001

(65) Prior Publication Data

US 2002/0050307 A1 May 2, 2002

(30) Foreign Application Priority Data

May 12, 2000 (JP) ..... 2000-140877

(51) Int. Cl.[7] ..... C23C 8/56
(52) U.S. Cl. ..... 148/218; 148/219
(58) Field of Search ..... 148/218

(56) References Cited

U.S. PATENT DOCUMENTS

| | | | | |
|---|---|---|---|---|
| 4,406,714 A | * | 9/1983 | Bowes et al. | 148/219 |
| 4,913,749 A | | 4/1990 | Hengerer et al. | 148/16 S |
| 5,595,610 A | | 1/1997 | Maeda et al. | 148/233 |

FOREIGN PATENT DOCUMENTS

| | | | | |
|---|---|---|---|---|
| GB | 1380635 | * | 1/1975 | C21D/6/00 |
| JP | 04198417 A | * | 7/1992 | C21D/6/00 |
| JP | 117059 | | 4/1999 | |

OTHER PUBLICATIONS

ASM vol. 4, Heat Treatment, 1995, ASM International, p. 380.*

* cited by examiner

*Primary Examiner*—Roy King
*Assistant Examiner*—Andrew Wessman
(74) *Attorney, Agent, or Firm*—Haverstock, Garrett & Roberts LLP; Veo Peoples, Jr.

(57) ABSTRACT

A method for high concentration carburizing and quenching of steel is provided which is carried out by a treatment process including the steps of carbonitriding the steel at temperatures of from about 800 to about 880° C., and subsequently quenching the steel at a temperature higher than the carbonitriding temperature. In the carbonitriding step, the steel is treated with carbon concentrations in a carburizing atmosphere taken as about 0.7 to about 1.2% and with 3 to 8% of ammonia gas ($NH_3$) being added, for example. This dissolves network-like carbide in austenite and, when the austenite is transformed into martensite by quenching, distributes the dissolved carbide in the form of granules approximately uniformly in the martensite. With the method, by the treatment process carried out with lower carburizing temperatures and simpler operation than those in the related art, the steel obtains excellent mechanical properties such as high hardness in surface portion, wear resistance, fatigue resistance, and high resistance to softening which are particularly suited for an automobile part.

5 Claims, 7 Drawing Sheets

| DISTANCE FROM SURFACE (mm) | HARDNESS Hv (300g) |
|---|---|
| 0 | 980 |
| 0.1 | 940 |
| 0.2 | 900 |
| 0.3 | 800 |
| 0.4 | 680 |
| 0.5 | 620 |
| 0.6 | 550 |
| 0.7 | 480 |
| 0.8 | 420 |
| 0.9 | 420 |
| 1.0 | 420 |

SURFACE STRUCTURE X 400

CROSS SECTION STRUCTURE X 400

| DISTANCE FROM SURFACE (mm) | HARDNESS HV (300g) |
|---|---|
| 0 | 940 |
| 0.1 | 860 |
| 0.2 | 780 |
| 0.3 | 700 |
| 0.4 | 650 |
| 0.5 | 600 |
| 0.6 | 590 |
| 0.7 | 580 |
| 0.8 | 580 |
| 0.9 | 580 |
| 1.0 | 580 |

SURFACE STRUCTURE X 400

CROSS SECTION STRUCTURE X 200

METHOD FOR HIGH CONCENTRATION CARBURIZING AND QUENCHING OF STEEL AND HIGH CONCENTRATION CARBURIZED AND QUENCHED STEEL PART

Applicant hereby claims foreign priority benefits under 35 U.S.C. § 119 of corresponding Japanese patent application No. 2000-140877, filed May 12, 2000.

BACKGROUND OF THE INVENTION

1. Field of the Invention

The present invention relates to a method for high concentration carburizing and quenching of steel which is suitable for a general machine part or a driving force transmitting part such as a gear, a bearing, a cam component for which high contact fatigue strength and wear resistance are required, and particularly suitable for such an automobile part subject to a possibility of being accompanied by hardness reduction caused by frictional heat due to rotation and sliding. The present invention also relates to a high concentration carburized and quenched steel part to which the method is applied.

2. Description of the Related Art

In general, a mechanical steel part in many cases must be provided with wear resistance with its surface hardness being increased and must keep its high toughness with its internal structure being made relatively soft. For this purpose, the steel is often treated with carburizing and quenching, or carbonitriding and quenching, for which carbon steel and alloy steel each having a carbon content of the order of 0.2% are used in such forms as case-hardened carbon steel, case-hardened alloy steel, machine structural steel, and machine structural alloy steel. Typical materials of such kinds of steel are chromium steel, chromium molybdenum steel, and nickel chromium molybdenum steel.

Incidentally, the above method for carburizing and quenching may be classified into a normal method for carburizing and a method for high-carbon carburizing (or method for high concentration carburizing). The normal method for carburizing is carried out in a carburizing atmosphere with a carbon concentration below that for $A_{cm}$ transformation. The method for high-carbon carburizing is for producing carbide with a carbon concentration in an atmosphere brought to a high level such that it is above the concentration corresponding to an intersection of the treatment temperature level with an $A_{cm}$ transformation curve in an iron-carbon system phase equilibrium diagram. When a high surface hardness is necessary, the latter method for high concentration carburizing is often employed. In the method for high concentration carburizing, the carbide is precipitated in network-like fashion along grain boundaries. A material with thus precipitated carbide has higher hardness and is excellent in wear resistance compared with a material treated with the normal method of carburizing, but it has a drawback of causing reduction in material strength.

In order to overcome the above drawback, it has been commonly practiced or carried out that the network-like carbide is granulated by making use of an $A_1$ transformation. Namely, the temperature is reduced from the carburizing temperature (usually 900° C. or above) down to the $A_1$ transformation temperature or below, or is kept around the $A_1$ transformation temperature for a long time to granulate the network-like carbide. The temperature is raised again thereafter for carrying out quenching treatment.

For example, U.S. Pat. No. 5,595,610 discloses the following method for producing case-hardened steel parts suitable for automobile parts in being particularly excellent in bending fatigue strength. Namely, according to the disclosed method, the steel parts are first carburized at 930° C., for example, before being gradually cooled at a rate of, for example, 20° C./minute for the subsequent heating held at 800° C. Thereafter, the temperature is once reduced down to 750° C. for being held at the temperature before quenching is carried out, by which the surface layer of the steel is made to have mixed structure mainly constituted of martensite and retained austenite.

Moreover, U.S. Pat. No. 4,913,749 discloses a method of producing rolling bearing elements in which the rolling bearing elements are case-hardened. According to the disclosed case-hardening process, the rolling bearing elements are carburized at 970° C. before being cooled down to 300° C. for being held at the temperature. The elements are thereafter heated up to 805° C. for being quenched or up to 610° C. for being annealed before being quenched at 805° C.

Furthermore, Japanese Patent kohkai 117059/1999 discloses a composition of steel for preventing precipitation of cementite when carburized at elevated temperatures of 980° C. or above together with the method for carburizing of the steel. The reference further discloses the following recent methods in the section of the prior art.

According to the disclosure, carburizing in recent years is carried out also by high temperature carburizing or vacuum carburizing. The high temperature carburizing is a method of carrying out RX gas carburizing at elevated temperatures of 950 to 1000° C., which uses RX gas (endothermic gas) as a carrier gas together with an enriched gas such as butane gas. The vacuum carburizing is a method of carrying out carburizing and carbide diffusing in a reducing atmosphere for which hydrocarbon gas is decomposed under reduced pressure.

A special method for carburizing is also proposed, in which two or more carburizing cycles are repeated with one or more of the carburizing cycles carried out under an atmosphere with a carbon concentration being above $A_{cm}$ carbon concentration.

In addition to the above methods for carburizing, in order to make the network-like carbide less liable to be produced, a method of carrying out high concentration carburizing is proposed which uses a steel having special composition.

However, there were the following problems in the above methods for high concentration carburizing and high concentration carburized and quenched parts in the related art.

1) As described above, in the method for high concentration carburizing, it is necessary to prevent the material from having a reduction in strength by removing the network-like carbide. This, however, requires a high carburizing temperature and a complicated treatment process. In addition, in the method for high concentration carburizing, there is a problem in that the retained austenite is liable to be produced, which tends to reduce hardness of the material with accompanied reduction in wear resistance.

2) In the method for high concentration carburizing, it is also necessary to increase the carbon concentration in the atmosphere as described above. This, however, produces soot resulting in so-called sooting problem. The soot attached to furnace material of the treatment facility causes a problem of reduction in material life of the furnace, and the soot attached to the material to be treated causes a problem of loss of brightness of the parts.

3) In addition, for the high concentration carburized and quenched parts, it is required that they obtain high surface portion hardness, wear resistance, and fatigue resistance by a simplified treating method without using any steel having special composition as described above. In particular, for automobile parts used in applications in sliding contact with other parts at elevated temperatures, it is required that they are provided with not only, of course, high hardness, but also high or good resistance to softening, that is, that the part surface hardness at elevated temperatures is not lowered below the part surface hardness at room temperature.

SUMMARY OF THE INVENTION

According to one aspect of the present invention, a method for high concentration carburizing and quenching of steel by which the steel can obtain desired mechanical properties by a treatment process with lower carburizing temperatures and simpler operation than those in the related art without causing any problem of producing soot, is disclosed.

According to another aspect of the present invention, a high concentration carburized and quenched steel part which has excellent mechanical properties such as high surface portion hardness, wear resistance, fatigue resistance, and high or good resistance to softening, and which is particularly suitable for an automobile part, is disclosed.

The method for high concentration carburizing and quenching of steel according to the present invention is to be carried out by a treatment process including the steps of carbonitriding the steel at temperatures of from about 800 to about 880° C., and subsequently quenching the steel at a temperature higher than the carbonitriding temperature. In the step of carbonitriding, the steel is treated with carbon (C) concentrations in a carburizing atmosphere of from about 0.7 to about 1.2 weight % carbon by weight of the steel and with from about 3 to about 8 volume % of ammonia gas ($NH_3$) being added, for example. This dissolves network-like carbide in autstenite and, when the austenite is transformed into martensite by quenching, distributes approximately uniformly the carbide granules in the martensite.

The manner in which the foregoing and other aspects of this invention are accomplished will be more apparent by referring to the following description and appended drawings.

DETAILED DESCRIPTION OF THE PREFERRED EMBODIMENTS

Figure 1:
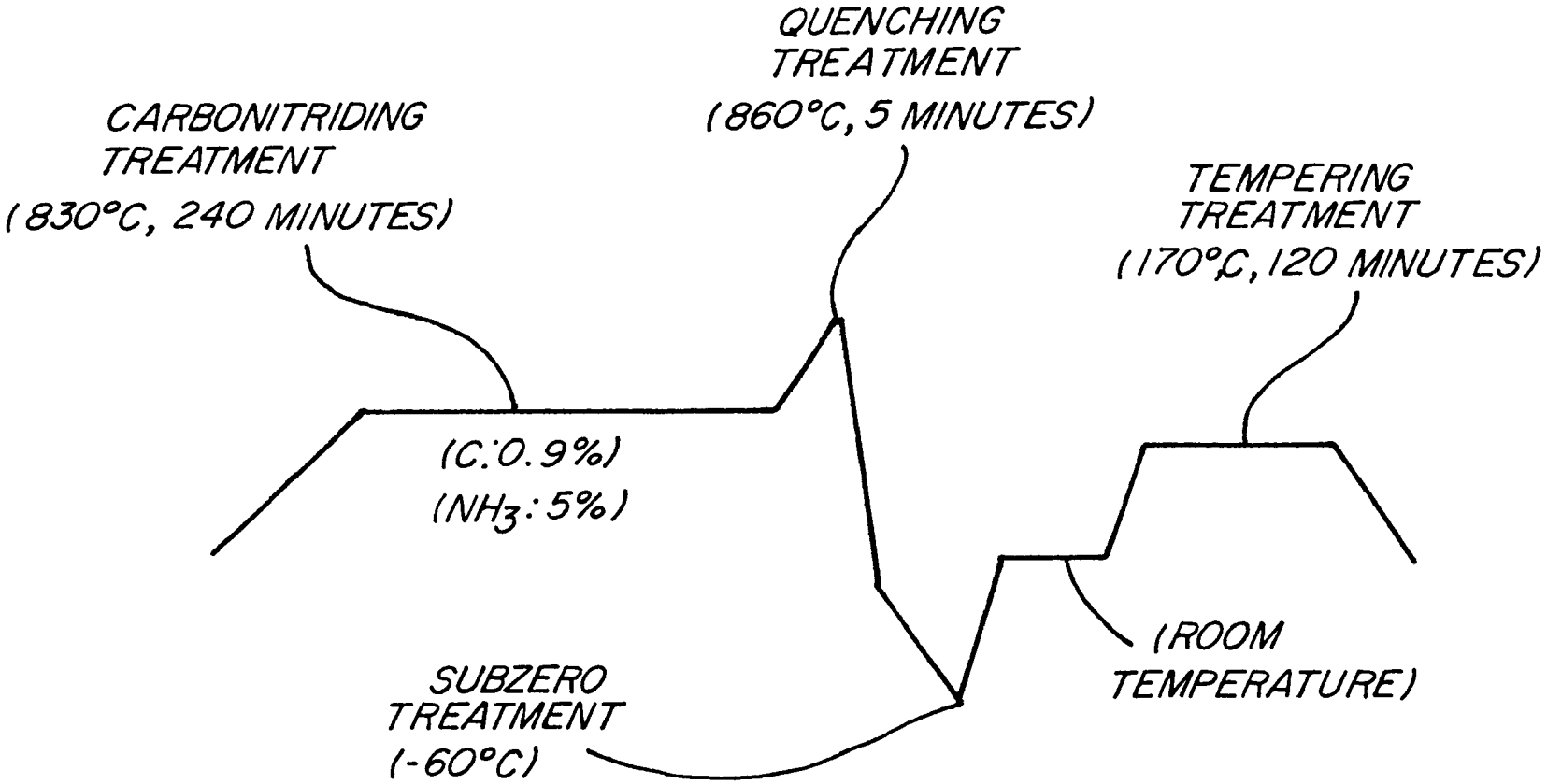
FIG. 1 is a diagram showing an example of a treatment process of a method for high concentration carburizing and quenching according to the present invention.

In the method for high concentration carburizing and quenching of steel according to the present invention, with the carburizing temperature set higher than that for the $A_{cm}$ transformation and lower than the quenching temperature and with a carbon concentration set also higher than that for the $A_{cm}$ transformation, carbonitriding is carried out at temperatures of from about 800 to about 880° C., lower than those in the methods in the related art, to precipitate carbide. Thereafter, the steel is heated for being quenched at temperatures a little higher than those for carbonitriding by, for example, about 20 to about 40° C. It is characterized in that, in the process of heating the steel up to the quenching temperature, only network-like carbide precipitated along grain boundaries is dissolved in austenite with carbide precipitated in boundaries of crystal grains being left behind, and the dissolved carbide is made reprecipitated to be distributed approximately uniformly in the form of granules in martensite as a quenched structure.

In the above method, ammonia gas added to the atmosphere shifts the $A_1$ transformation point and the $A_{cm}$ transformation curve in an iron-carbon system phase equilibrium diagram to the left and downward. This can precipitate the carbide with the carbon concentration in the atmosphere taken as that in a normal carburizing treatment without any particular increase therein, and can also lower the treatment temperature. This therefore further facilitates preventing soot from being produced.

In the carbonitriding treatment step, as described above, the steel is treated with carbon (C) concentrations in a carburizing atmosphere of from about 0.7 to about 1.2% and with from about 3 to about 8% of ammonia gas ($NH_3$) being added. According to the method for high concentration carburizing and quenching, the carburizing temperature is lowered and the treatment process is simplified compared with those in the related art. Moreover, as will be described later, a high concentration carburized and quenched steel part can be provided which has excellent mechanical properties such as high surface portion hardness, wear resistance, fatigue resistance, and high softening resistance. The steel such as the above described case-hardened carbon steel, case-hardened alloy steel, mechanical structural steel, or mechanical structural alloy steel can be used as an object or part.

In addition, in the above described method, it is preferable that the treatment process includes the steps of, after the step of quenching, carrying out subzero treatment, and carrying out tempering treatment. The step of carrying out subzero treatment step is for carrying out subzero treatment at, for example, about −60° C., which step is, as well known, well suited for transforming retained austenite into martensite for improving hardness and wear resistance. The step of carrying out tempering treatment is, by carrying out tempering around, for example, 200° C., well suited for finely precipitating a part of carbide and nitride, and for removing and adjusting a part of macroscopic internal stress produced by quenching.

Furthermore, the carbon concentration and the amount of added $NH_3$ are preferably controlled so that the surface of the treated steel part is kept free from soot.

Next, as a high concentration carburized and quenched steel part to which the above described method is applied, the following is preferable. First, in the high concentration carburized and quenched steel part such as the one of case-hardened steel or machine structural steel, a carburized layer is to have a structure in which granular carbides are dispersed approximately uniformly in martensite, and to have a hardness Hv (300 g) of 550 or more from the surface of the part to a depth of at least 0.5 mm. This can provide the part with high surface hardness, wear resistance and fatigue resistance without using any steel having a special composition.

It is more preferable that the case-hardened steel is chromium molybdenum steel with a part surface hardness at least at about 200° C. being equivalent to that at room temperatures. This allows the chromium molybdenum steel part to be suitably provided for such an automobile part as is required to have a high or good resistance to softening for use in applications wherein the part is slid or rotated with generation of frictional heat.

Furthermore, the high concentration carburized and quenched steel part is most preferably provided as an automobile part such as a pinion shaft, a governor shaft, a fluid bearing shaft, a valve seat, a gear sleeve, or an associated part of a turbo charger. In particular, it is required that the pinion shaft exhibits no reduction in surface hardness around 220° C. and increased resistance to wearing and seizing. Therefore, electroless nickel plating has been used on the surface of the part in the related art. Moreover, the governor shaft in the related art is coated with hard chrome plating. Thus, application of the high concentration carburized and quenched steel part also allows the above referenced plating to be omitted or eliminated, so that high technical and commercial merit will be achieved by the present invention.

Following, embodiments of the present invention will be explained with examples on the basis of FIG. 1 to FIG. 9.

EXAMPLE 1

In FIG. 1, there is shown a high concentration carburizing and quenching treatment process relating to an example 1 of the present invention. In FIG. 1, the material to be treated is a specimen of chromium molybdenum steel SCM415 (JIS G 4105), whose dimensions were taken as 18 mm in diameter and 100 mm in length. As shown in FIG. 1, the first step of carbonitriding was carried out for 240 minutes with a carbonitriding temperature and a carbon concentration in the atmosphere taken as 830° C. and 0.90, respectively, with 5% of ammonia gas being added. Thereafter, the material was heated up to 860° C. and held for 5 minutes at the temperature before being quenched in quenching oil at 60° C.

Thereafter, the material was subjected to subzero treatment at −60° C. The temperature was then brought back to the room temperature. Thereafter, tempering was carried out at 170° C. for 120 minutes. In the example, the rate of temperature rise was taken as 20° C./10 minutes when heating the material up to 860° C. When increasing the rate of temperature rise for dissolving in austenite the network-like carbon precipitated along grain boundaries, it is better to take the retention time at 860° C. somewhat longer. The surface hardness of the material treated as above was obtained as 960 in Hv (300 g), which was very high. The surface hardness obtained by a normal method for carburizing and quenching is generally 720 to 780 in Hv (300 g). Explanation about a surface hardness distribution and a metal structure of the carburized layer will be given later together with those obtained in different examples.

EXAMPLE 2

Figure 2:
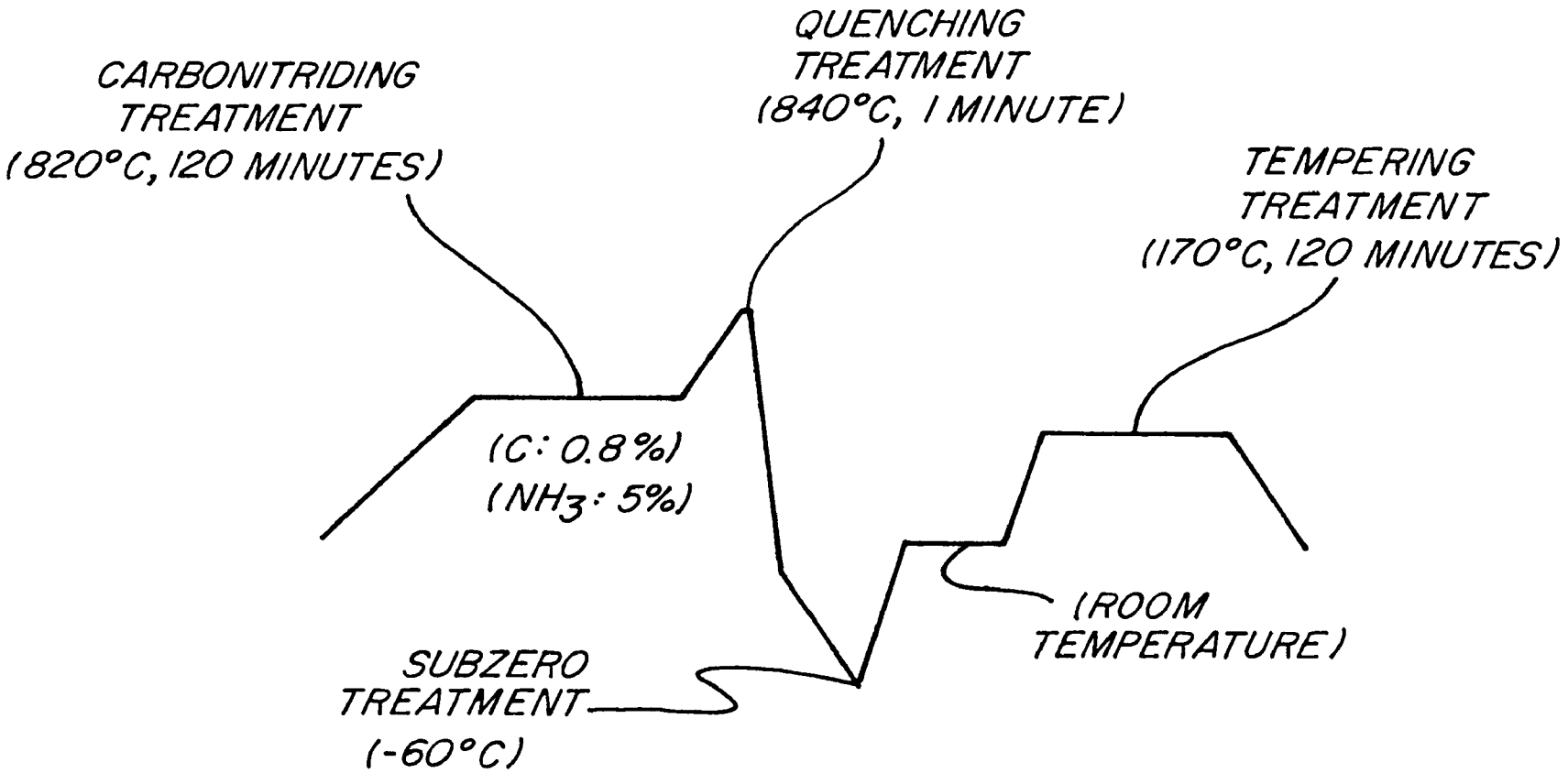
FIG. 2 is a diagram showing another example of the treatment process of the method of high concentration carburizing and quenching according to the present invention, which is different from the treatment process shown in FIG. 1.

In FIG. 2, there is shown a high concentration carburizing and quenching treatment process relating to an example 2 of the present invention. In FIG. 2, material to be treated is a specimen of chromium molybdenum steel SCM435 (JIS G 4105), whose dimensions were taken as 20 mm in diameter and 100 mm in length. As shown in FIG. 2, the first step of carbonitriding was carried out for 120 minutes with a carbonitriding temperature and a carbon concentration in an atmosphere taken as 820° C. and 0.8%, respectively, with 5% of ammonia gas being added. Thereafter, the material was heated up to 840° C. and held for 1 minute at the temperature with the following treatments carried out similarly to those in the example 1. The rate of temperature rise up to 840° C. was also taken as being the same as that in the example 1. The surface hardness of the material treated as above was obtained as 940 in $H_v$ (300 g), which was very high like that in the example 1.

EXAMPLE 3

Figure 3:
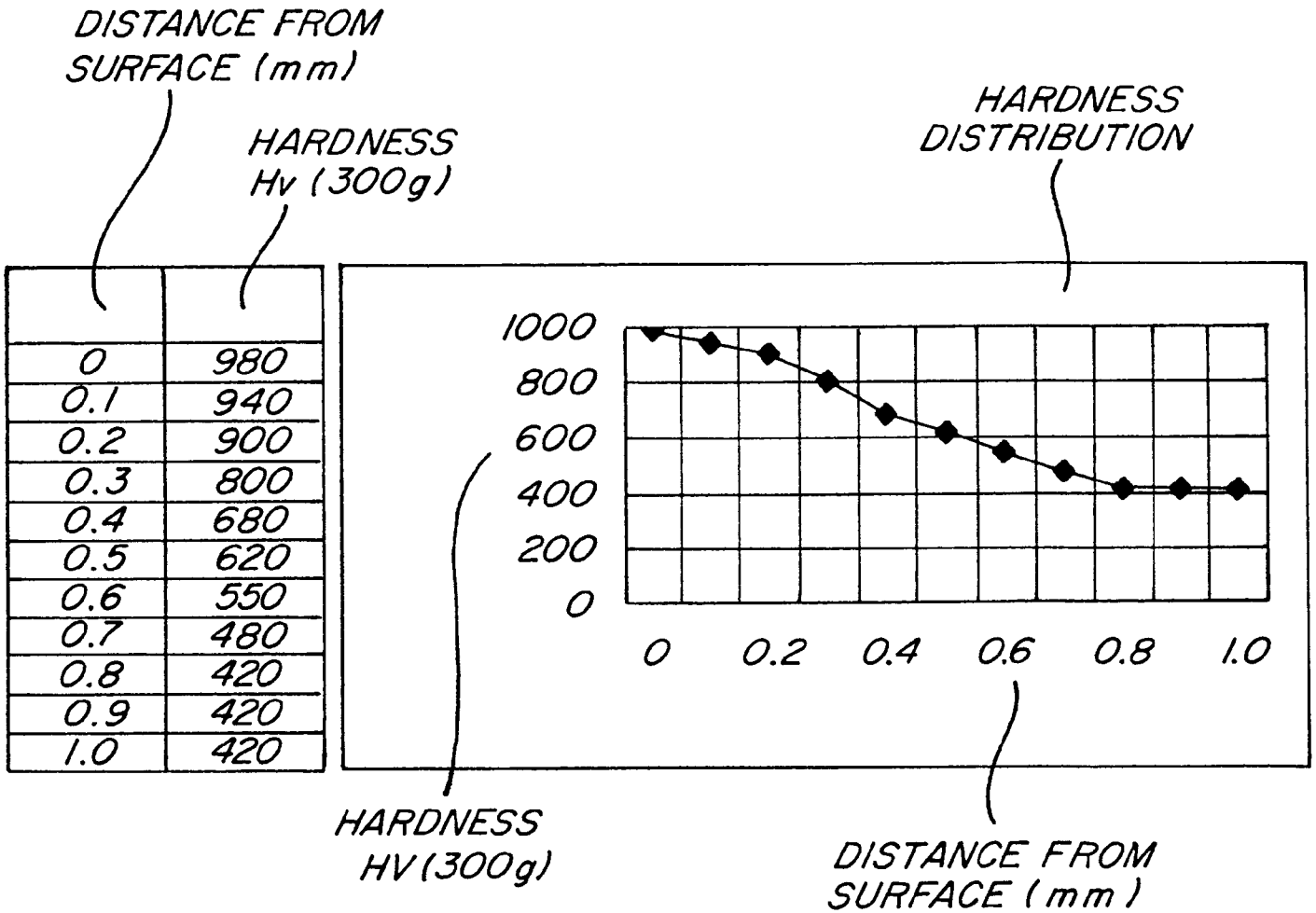
FIG. 3 is a diagram showing results of measurements on the surface hardness and hardness distribution in the direction of a depth of a treated material relating to an example 3.
Figure 4:
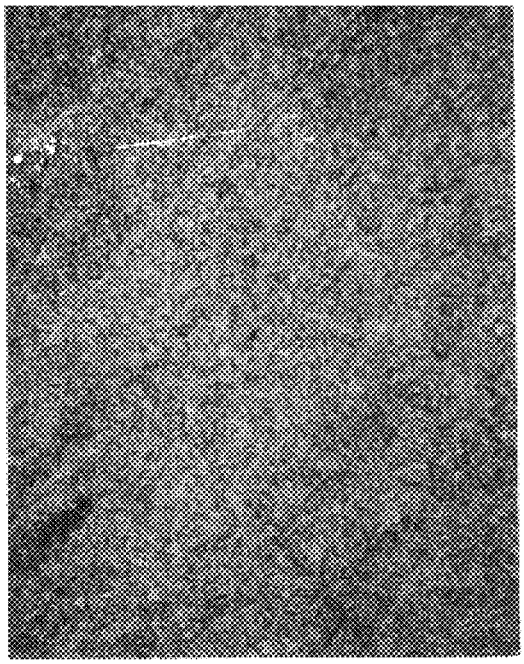
FIG. 4 is a micrograph showing a surface structure of a metal structure of a carburized layer of the treated material relating to the example 3.
Figure 5:
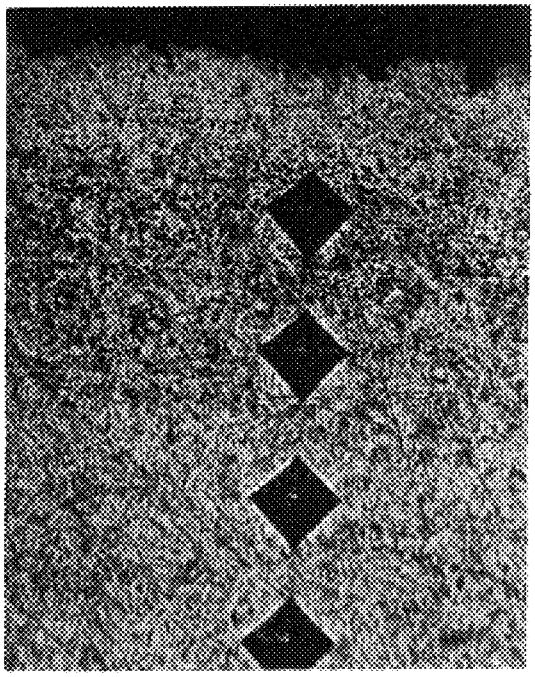
FIG. 5 is micrograph showing a cross section structure of a metal structure of a carburized layer of the treated material relating to the example 3.

In FIG. 3, there are shown results of measurements on the surface hardness and hardness distribution in the direction of depth of the treated material specimen relating to example 3. In FIG. 4 and FIG. 5, there are respectively shown micrographs of a surface structure and a cross section structure of a metal structure of a carburized layer of the treated material specimen in the example 3. The specimen material to be treated in the example 3 was taken as chromium molybdenum steel SCM418 (JIS G 4105) as the material for a pinion shaft. The high concentration carburizing and quenching treatment process was carried out similarly to that in the example 1.

As shown in FIG. 3, a part was obtained which exhibited a very high surface hardness of 980 and, even at a depth of 0.5 mm from the surface, exhibited a high hardness of 620.

According to the micrographs in FIG. 4 and FIG. 5 showing the surface structure and the cross section structure, respectively, it is observed that fine granular carbide (white parts in the photographs) is precipitated in martensite without any existence of network-like carbide, and the fine granular carbide is distributed deeply from the surface. In the photograph in FIG. 5, the four black rhombuses are indentations of a diamond indenter used at the hardness measurement.

It has been shown that the material for a pinion shaft according to the example 3 has high resistance to wearing and seizing due to the high hardness and the carbide distribution as described above, and has such a high resistance to softening as to cause no reduction in surface hardness with temperature rise of the material at least up to 220° C.

EXAMPLE 4

Figure 6:
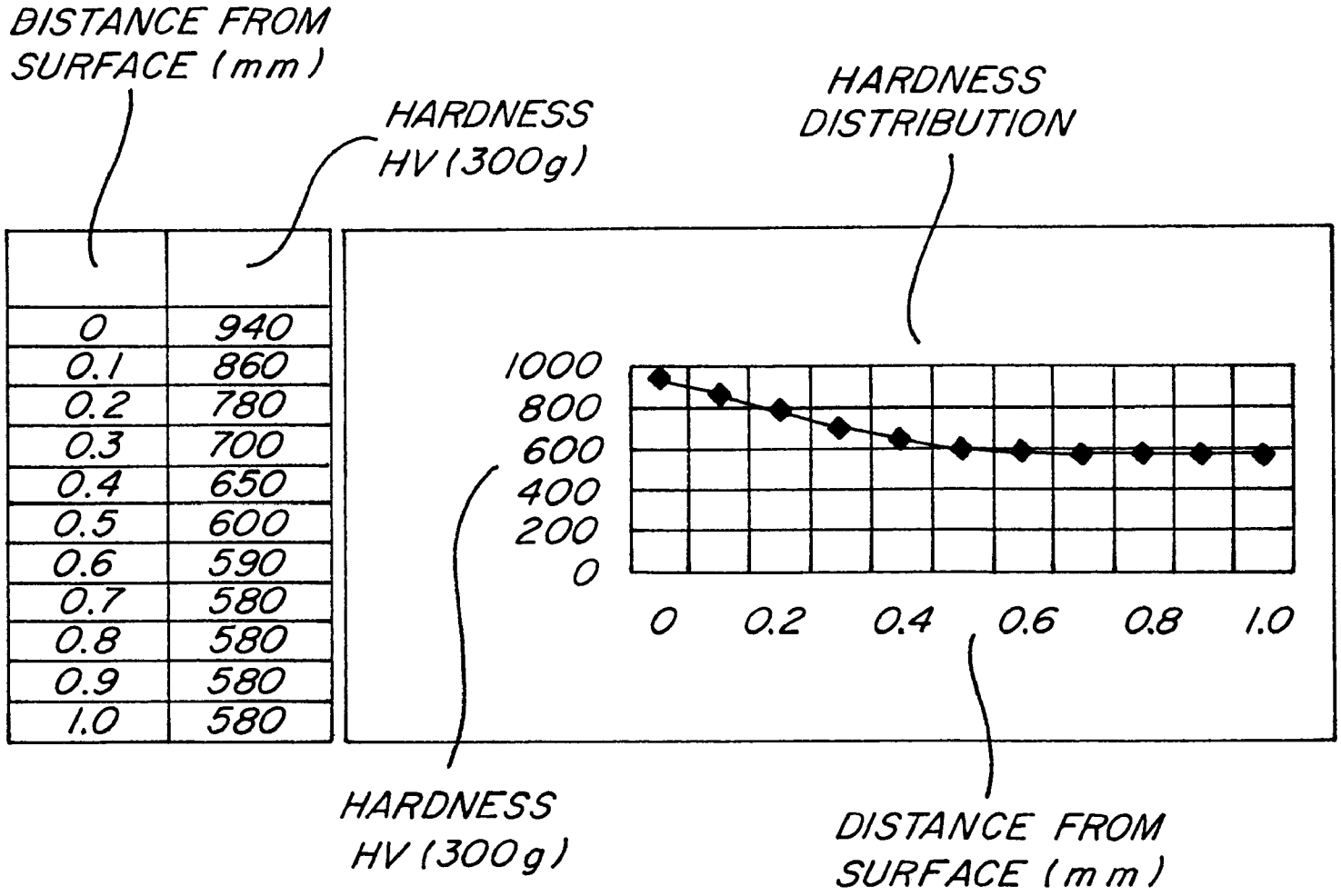
FIG. 6 is a diagram showing results of measurements on the surface hardness and hardness distribution in the direction of a depth of a treated material relating to an example 4.
Figure 7:
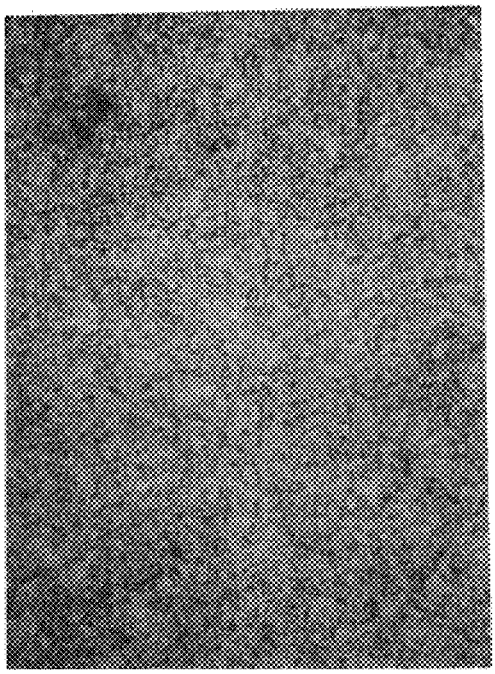
FIG. 7 is a micrograph showing a surface structure of a metal structure of a carburized layer of the treated material relating to the example 4.
Figure 8:
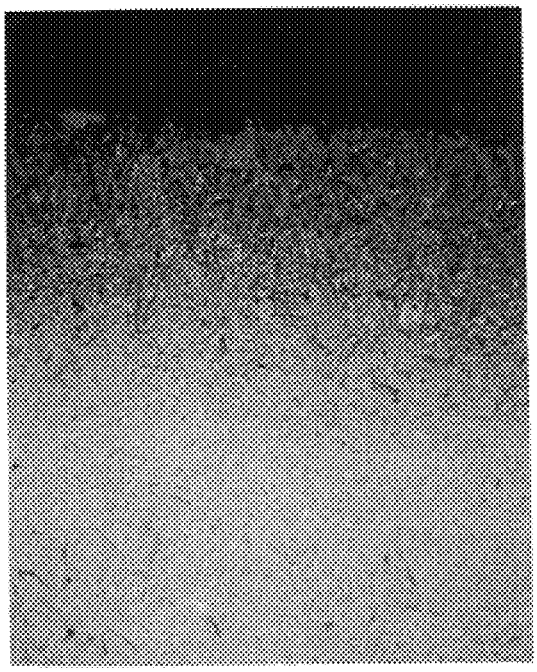
FIG. 8 is a micrograph showing a cross section structure of a metal structure of a carburized layer of the treated material relating to the example 4.

In FIG. 6, there are shown results of measurements of the surface hardness and hardness distribution in the direction of depth of a treated material specimen relating to an example 4. In FIG. 7 and FIG. 8, there are respectively shown micrographs of a surface structure and a cross section structure of a metal structure of a carburized layer of the material specimen in the example 4. The material to be treated in the example 4 was taken as chromium molybdenum steel SCM435 (JIS G 4105). The high concentration carburizing and quenching treatment process was carried out similarly to that in the example 2.

As shown in FIG. 6, a part was obtained which exhibited a very high surface hardness of 940 and, even at a depth of 0.5 mm from the surface, exhibited a high hardness of 600. Furthermore, also at a depth of 1.0 mm from the surface, a high hardness of 580 was exhibited.

According to the micrographs in FIG. 7 and FIG. 8 showing the surface structure and the cross section structure, respectively, it is observed like in the example 3 that fine granular carbide is precipitated in martensite without any existence of network-like carbide, and the fine granular carbide is distributed deeply from the surface.

EXAMPLE 5

Figure 9:
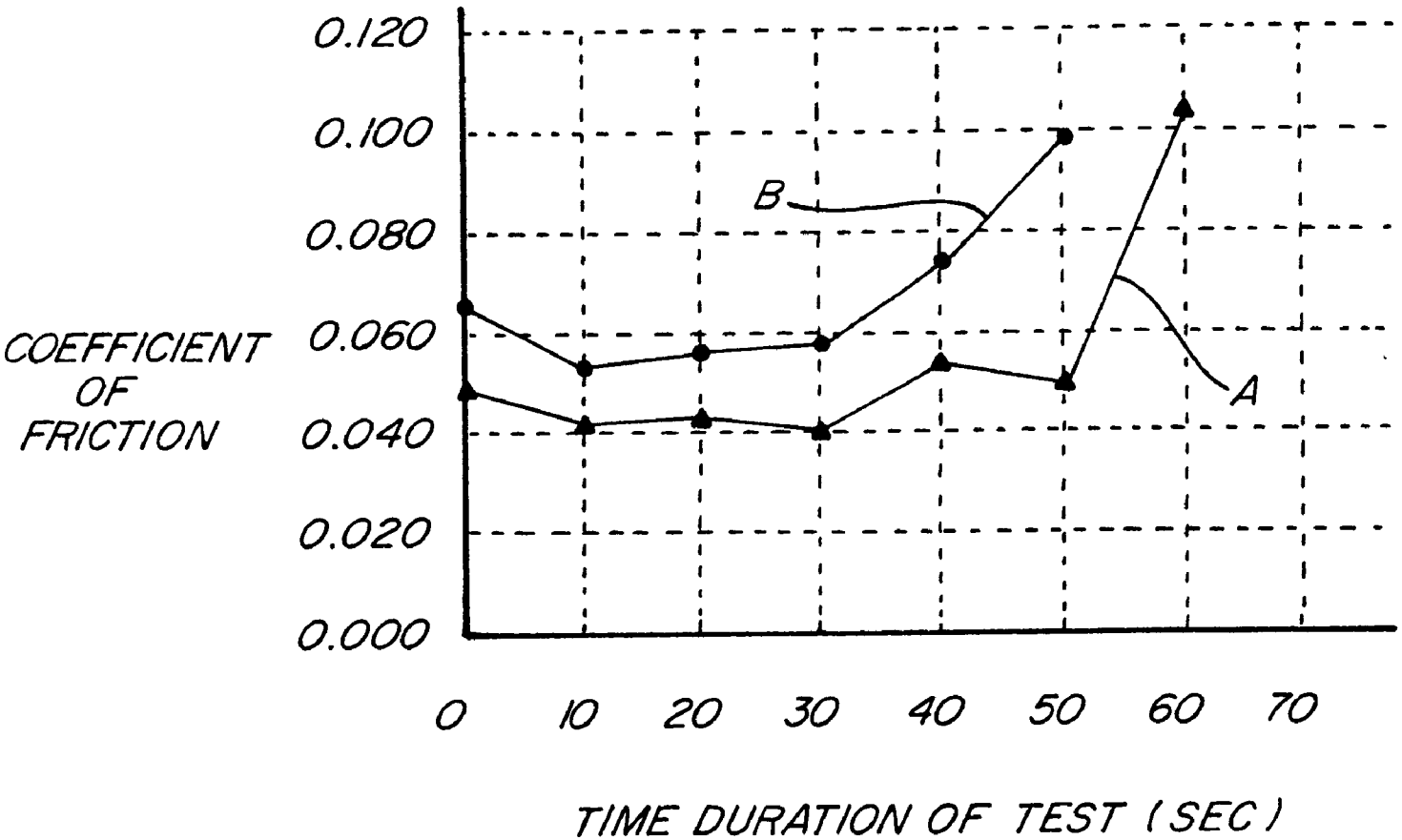
FIG. 9 is a diagram showing results of measurements on the coefficient of friction of a treated material relating to an example 5.

FIG. 9 is a diagram showing results of measurements on the coefficient of friction of the treated material relating to an example 5 as an index for evaluating resistance to wear and seizing thereof. The test piece in the example 5 was taken as chromium molybdenum steel SCM415 (JIS G 4105) as the material for a pinion shaft.

In the diagram in FIG. 9, the vertical axis and the horizontal axis represent coefficient of friction and time duration of the test (in seconds), respectively. In the diagram, the reference character "A" denotes the result of measurement about a test piece which was prepared by carrying out a surface treatment of the high concentration carburizing and quenching similarly to that in the example 1 about a material, for which SCM415 was treated by normal carburizing and quenching followed by tempering. The reference character "B" denotes the result for a test piece which was subjected to no surface treatment of the above and is shown as"untreated" in Table 1 below.

The results shown in FIG. 9 were obtained from measurements using a Falex abrasion tester. Test pieces such as fixed test pieces and rotation test pieces, and test conditions, are also shown in the following Table 1.

TABLE 1

| | | | |
|---|---|---|---|
| Test Pieces | Fixed Test Piece (V block) | SCM415 Carburized & Quenched and Tempered | Surface Treatment: Untreated |
| | Rotation Test Piece (Pin) | SCM415 Carburized & Quenched and Tempered | Surface Treatment: A: High Concentration Carburizing & Quenching B: Untreated |
| Test Conditions | Test Environment | Lubricated (Lubricant Application After Acetone Degreasing) | |
| | Sliding Speed | 0.1 m/sec | |
| | Loading Condition | Increased Load from 220 kgf | |

As is apparent from the results shown in FIG. 9, the rotation test piece A subjected to the high concentration carburizing and quenching treatment according to the present invention presented a relatively smaller coefficient of friction compared with that of the test piece B. This shows that the present invention can be applied to improve resistance to wear and seizing of rotating parts such as those for pinion shafts and fluid bearing shafts.

Although the present invention has been explained in reference to the above five examples, it is understood that various variations are possible about the treatment process within the spirit and the scope of the present invention. In particular, the treatment conditions such as the treatment temperatures, treatment time, and treatment atmosphere are not limited to the above examples.

What we claim are:

1. A method for high concentration carburizing and quenching of steel carried out by a treatment process including the steps of:

carbonitriding the steel at temperatures of from about 800° C. to about 880° C.; and subsequently heating the steel to a temperature higher by about 20° to 40° C. than the carbonitriding temperature, followed by quenching the steel.

2. The method for high concentration carburizing and quenching of steel as claimed in claim 1 wherein the step of carbonitriding is for treating the steel with carbon (C) concentrations in a carburizing atmosphere of from about 0.7 to about 1.20 weight percent carbon by weight of the steel, and with from about 3 to about 8 volume percent of ammonia gas ($NH_3$) being added.

3. The method for high concentration carburizing and quenching of steel as claimed in claim 1 wherein the step of carbonitriding is for precipitating carbide and the step of heating is for dissolving, of the precipitated carbide, only carbide precipitated in network-like manner along grain boundaries in austenite, whereby the granular carbide precipitated at the grain boundaries is left, and wherein, quenching, the austenite is transformed into martensite approximately uniformly distributing the carbide granules in the martensite.

4. The method for high concentration carburizing and quenching of steel as claimed in claim 2, wherein the carbon concentration and the amount of added $NH_3$ are controlled so that the surface of the treated steel is kept from soot.

5. The method for high concentration carburizing and quenching of steel as claimed in any one of claims 3 or 2, wherein the treatment process further includes the steps of:

after the step of quenching, carrying out subzero treatment; and carrying out tempering treatment.

* * * * *